US005117960A

United States Patent [19]

Ahls et al.

[11] Patent Number: 5,117,960

[45] Date of Patent: Jun. 2, 1992

[54] LINEAR BELT HANDRAIL DRIVE

[75] Inventors: Hermann W. Ahls, OT Vehlen; Helmut Meyer, Hanover; Olaf Wurzler, Minden, all of Fed. Rep. of Germany

[73] Assignee: Otis Elevator Company, Farmington, Conn.

[21] Appl. No.: 745,565

[22] Filed: Aug. 15, 1991

[51] Int. Cl.[5] ..... B66B 23/04

[52] U.S. Cl. ..... 198/335; 198/833

[58] Field of Search ..... 198/335, 336, 330, 331, 198/833

[56] References Cited

U.S. PATENT DOCUMENTS

| | | | |
|---|---|---|---|
| 3,414,109 | 12/1968 | Clark | 198/335 |
| 3,779,360 | 12/1973 | Taher et al. | 198/335 |
| 4,134,883 | 1/1979 | Mendelsohn et al. . | |
| 4,875,568 | 10/1989 | Hermann et al. | 198/335 |

FOREIGN PATENT DOCUMENTS

| | | | |
|---|---|---|---|
| 247236 | 5/1966 | Austria . | |
| 270500 | 7/1968 | Fed. Rep. of Germany | 198/335 |
| 1484075 | 6/1967 | France | 198/335 |
| 52-31479 | 9/1977 | Japan . | |
| 1286-493A | 1/1982 | U.S.S.R. . | |
| 1393745 | 5/1988 | U.S.S.R. | 198/335 |
| 1481182 | 5/1989 | U.S.S.R. | 198/335 |

*Primary Examiner*—D. Glenn Dayoan

*Attorney, Agent, or Firm*—Williams W. Jones

[57] ABSTRACT

An escalator or moving walkway handrail is driven by a pair of linear belts which engage opposite sides of the handrail along the return path of travel thereof. The belt that engages the underside of the handrail is a powered drive belt, and the belt that engages the upper-side of the handrail is a pressure or reaction belt. Both belts are held against the handrail by a set of biased pressure rollers which urge the reaction belt against the handrail. The belts serve to convert line contact with the pressure rollers into area contact with the handrail thereby spreading out the driving forces acting upon the handrail.

5 Claims, 3 Drawing Sheets

LINEAR BELT HANDRAIL DRIVE

TECHNICAL FIELD

This invention relates to a handrail drive for escalator or moving walkway handrails. More particularly, this invention relates to a handrail drive which spreads the compressive forces applied to the handrail to reduce concentrated stressing of the handrail.

BACKGROUND ART

Moving handrails on an escalator or moving walkway are typically driven by passing the handrails through a driving pressure nip along the return path of travel of the handrail beneath the balustrades. The nip may be formed by a pair of cooperating rollers, or by a driven belt which cooperates with a plurality of backup rollers. The nip will be powered by chains or the like which are driven by the main drive mechanism of the escalator. Soviet Patent No. SU1286-493A, U.S. Pat. No. 4,134,883, and Austrian Patent No. 247,236 disclose variations of the prior art drive systems described above.

When the handrail is contacted directly by rollers in the nip, either drive rollers, backup rollers, or both, a line contact occurs between the handrail and rollers. A large compressive force is thus concentrated in a line and applied to the handrail. These localized compressive forces can weaken the handrail and shorten its useful life. Another problem which occurs when direct roller to handrail contact is used concerns slippage of the rollers relative to the handrail. This slippage is the result of the rollers' speed being in terms of angular velocity while the handrail's speed is present as rectilinear velocity.

Japanese Kokai 52,31479 dated Sep. 3, 1977 relates to a handrail driving device which limits localized bending of the handrail and prevents accumulation of dirt on the exposed surface of the handrail. The Japanese drive uses a reaction belt which contacts the exposed side of the handrail, which belt is looped about two idler rollers and passes over a spring-biased pressure plate which urges the belt against the handrail. The reaction belt thus must be formed with a high coefficient of friction side which contacts the handrail, and a low coefficient of friction opposite side which contacts the pressure plate. Care must be taken not to scuff the handrail with the reaction belt.

DISCLOSURE OF THE INVENTION

This invention relates to an improved escalator handrail drive which does not produce localized stressing or deformation of the handrail, and which does involve passing the handrail along a pronounced curvilinear path of travel in the drive area. The handrail is driven as it passes along a rectilinear path of travel. The handrail passes through a nip formed by a pair of belts. One of the belts is a powered drive belt and the other is a reaction or pressure belt. Both belts are entrained over sets of rollers comprising end deflection rollers and intermediate pressure rollers. In this manner the problem of scuffing of the handrail by the reaction belt is eliminated. The linear squeezing of the handrail by the rollers is also eliminated due to the intervening belts. The reaction rollers are each mounted on their separate spring biased axles which include stems positioned to one side of the handrail. The handrail is thus easily removable from the drive assembly by removing one of the side walls or skirts of the escalator.

It is therefore an object of this invention to provide an improved escalator or moving walkway handrail drive which does not unduly stress or deform the handrail.

It is a further object of this invention to provide a handrail drive of the character described which will not scuff the handrail.

It is another object of this invention to provide a handrail drive of the character described which allows easy servicing, and withdrawal of the handrail from the drive nip.

These and other objects and advantages of the invention will become more readily apparent from the following detailed description of a preferred embodiment of the invention when taken in conjunction with the accompanying drawings, in which:

BEST MODE FOR CARRYING OUT THE INVENTION

Figures 1, 2:
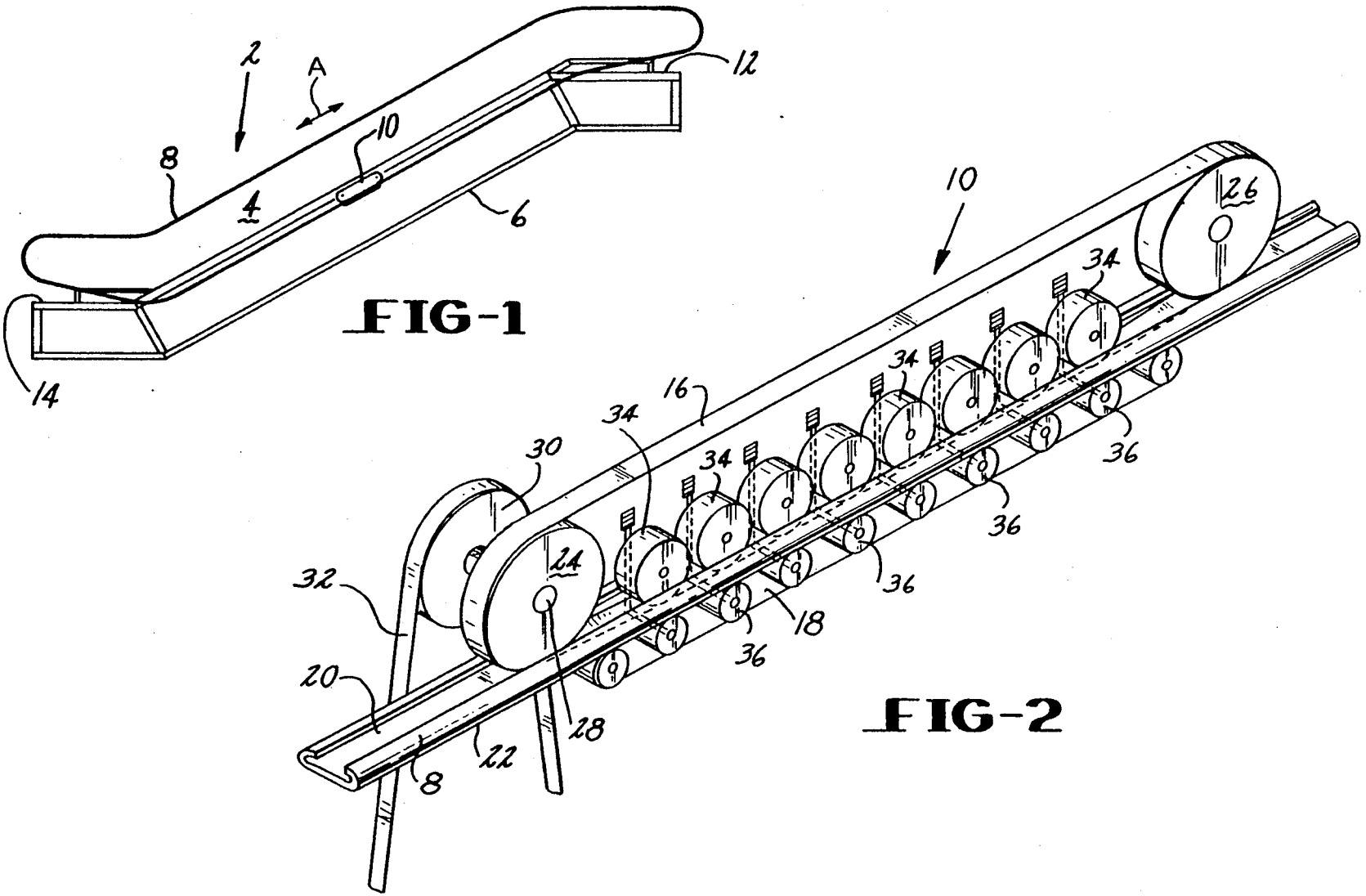
FIG. 1 is a schematic side elevational view of an escalator equipped with the handrail drive assembly of this invention.
FIG. 2 is a somewhat schematic perspective view of the handrail drive.

Referring now to the drawings, there is shown in FIG. 1 a schematic representation of an escalator denoted by the numeral 2, which includes a balustrade 4 mounted on a truss 6, and over which a handrail 8 is moved by a handrail drive 10 formed in accordance with this invention. The drive 10 is mounted on the truss 6 just below the balustrade 4. Due to the relatively flat nature of the drive 10, it does not have to be buried deeply in the truss 6, and it is relatively readily accessed for servicing and repair. The escalator 2 has upper and lower landings 12 and 14 respectively between which passengers are moved. If the escalator 2 is designed to operate in either direction, as indicated by the arrow A, the drive 10 will be placed medially along the inclined portion of the truss 6. When the escalator is intended to be driven in only one of the two directions, the drive 10 will be located closer to the landing 12 or 14 which is the exit landing.

FIG. 2 discloses details of the drive 10 in a somewhat schematic representation. The handrail 8 passes between two belts 16 and 18 which provide a rectilinear zone of driving contact with the handrail 8. One belt 16 contacts the inner surface 20 of the handrail 8 and the other belt 18 contacts the outer surface of 22 of the handrail 8. The belt 16 passes over two deflection rollers 24 and 26 which define opposite ends of the drive 10. One of the rollers 24 or 26 is mounted on a common rotating shaft 28 with a power roller 30 which is powered by a power belt 32 that may be connected to the main power drive for the escalator 2. A plurality of presser rolls 34 are interposed between the rollers 24 and 26, and serve to press the drive belt 16 against the surface 20 of the handrail 8. A plurality of spring-biased reaction rollers 36 serve to press the reaction belt 18 against the surface 22 of the handrail 8.

Figure 3:
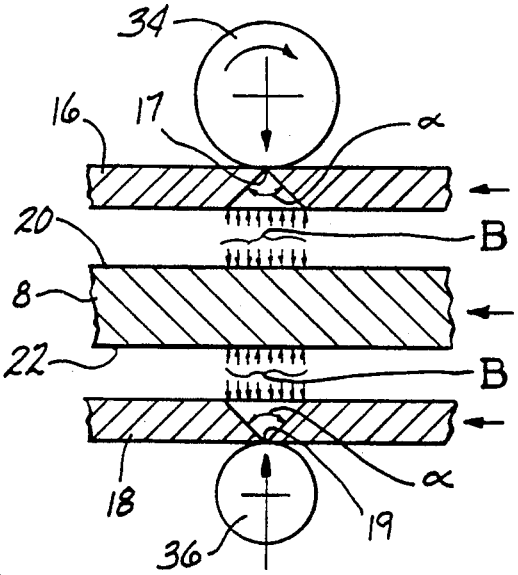
FIG. 3 is an exploded schematic side view of the handrail, belts, and rollers of the drive assembly showing the distribution of compressive forces imposed on the handrail by the drive.

FIG. 3 illustrates the manner in which the compressive forces acting on the handrail 8 from the rollers 34 and 36 via the belts 16 and 18 respectively are spread out over the surfaces 20 and 22 of the handrail 8. It is noted that the rollers 34 and 36 load the belts 16 and 18 along transverse lines 17 and 19. The belts 16 and 18 then spread the linear loads through 90° included angles δ so that the load applied by the belts 16 and 18 to the handrail 8 are distributed over an area as shown by arrows B, thereby diffusing the stresses imparted to the handrail in the drive.

Figure 5:
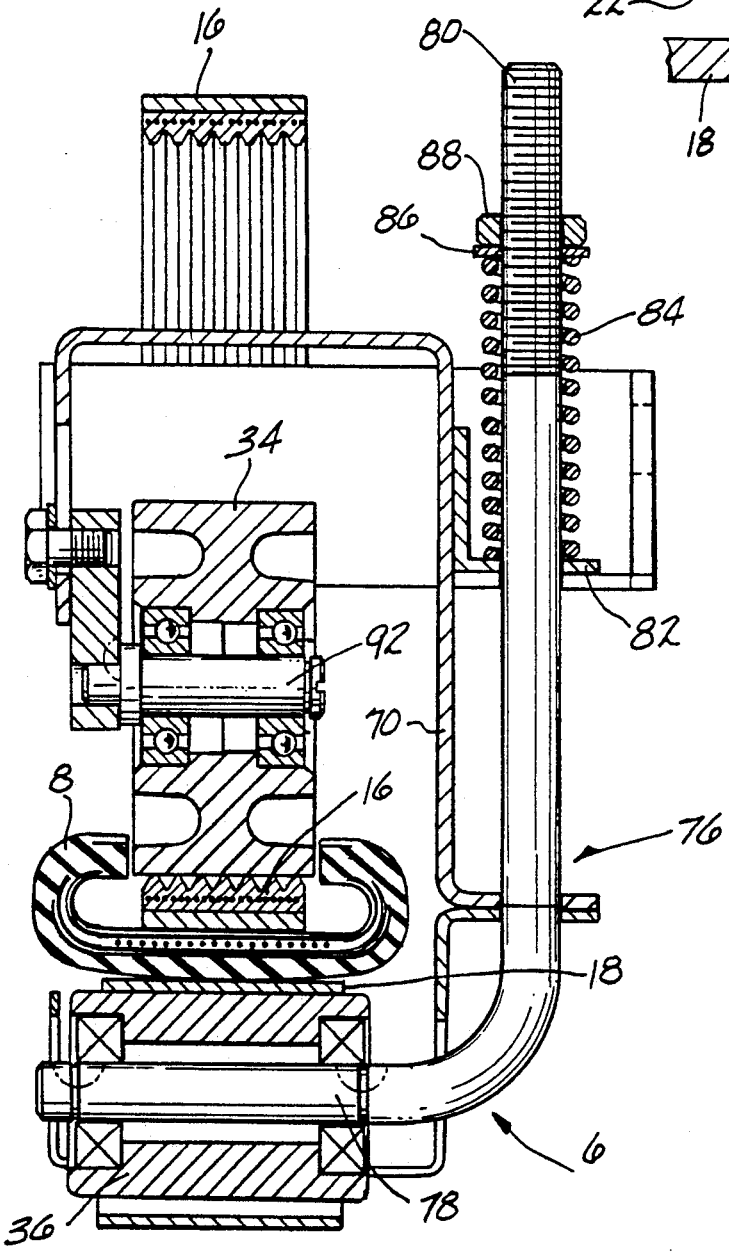
FIG. 5 is a view of the drive assembly taken along line 5—5 of FIG. 4.
Figure 4:
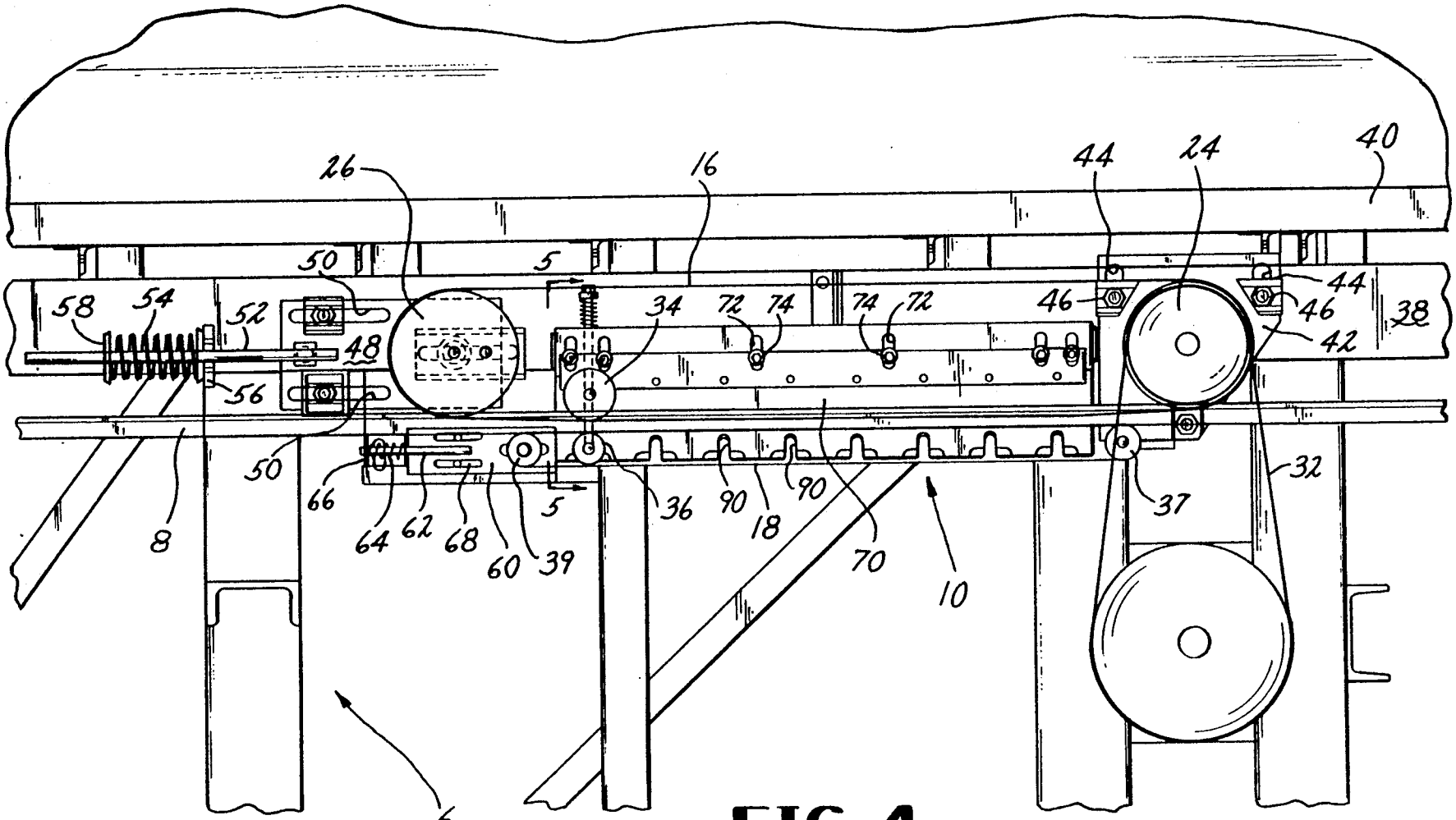
FIG. 4 is a fragmented side elevational view of the drive assembly showing how it is mounted on the escalator truss.

Referring to FIGS. 4 and 5, details of the drive 10 and the manner in which it is mounted on the truss 6 are shown. As seen in FIG. 4, the truss 6 has a support plate 38 which is disposed just below the lower balustrade support 40. The roller 24 is mounted on a plate 42 which is fixed to the support plate 38. The plate 42 is vertically adjustable by reason of elongated openings 44 therein which receive bolts 46 threaded into the support plate 38. The roller 26 is mounted on a bracket 48 which is laterally movable by reason of elongated holes 50. A spring guide rod 52 is secured to the bracket 48 and carries a coil spring 54 sandwiched between a first spring seat 56 fixed to the truss 6, and a second spring seat 58 fixed to the rod 52. The roller 26 is thus spring biased away from the roller 24 whereby tension on the belt 16 is maintained. The reaction belt 18 is entrained about two endmost deflection rollers 37 and 39. The roller 37 is mounted on the plate 42, and the roller 39 is mounted on a bracket 60. A spring guide rod 62 is secured to the bracket 60 and carries a spring 64 and a spring stop 66. Elongated mount slots 68 in the bracket 60 allow a similar biasing of the roller 39 away from the roller 37 to maintain tension in the reaction belt 18. A panel 70 is secured to the truss 6 between the plate 42 and bracket 48. The panel 70 is vertically adjustable on the truss 6 by reason of elongated slots 72 and fasteners 74. The panel 70 carries the reaction rollers 36, as is more clearly shown in FIG. 5, and the pressure rollers 34. The reaction rollers 36 are mounted on L-shaped rods 76 which include a horizontal foot 78 and a vertical stem 80. The stem 80 passes through a flange 82 on the back of the panel 70. A spring 84 is mounted on the stem 80 and is sandwiched between the flange 82 and a washer 86 fixed to the upper end of the stem 80 by a nut 88. The nuts 88 allow adjustment of the spring pressure acting on the rollers 36. The foot 78 passes through a slot 90 in the panel 70 (see FIG. 4) so as to allow the springs 84 to bias each of the rollers 36, and thus the belt 18 upwardly against the handrail 8. The rollers 34 are mounted on axles 92 secured on the panel 70.

It will be readily appreciated from FIG. 4 that the drive 10 is readily accessible for servicing since it is disposed closely to the balustrade holder 40 and can be accessed simply by removing a side panel on the escalator. The drive automatically retains tension on the belts, and is readily adjustable on the escalator truss. Pressure of the belts on the handrail is also automatically maintained.

Since many changes and variations of the disclosed embodiment of the invention may be made without departing from the inventive concept, it is not intended to limit the invention other than as required by the appended claims.

What is claimed is:

1. A drive assembly for a moving handrail in a passenger conveyor, said drive assembly comprising:

(a) an endless drive belt engaging one surface of the handrail, said drive belt being reeved about a pair of spaced apart deflection rollers;

(b) a plurality of presser roller interposed between said deflection rollers and engaging said drive belt to hold the latter against the handrail, said deflection and presser rollers being mounted on a plate, which plate in turn is mounted on a truss for the passenger conveyor and said plate being adjustable on said truss toward and away from said handrail belt;

(c) an endless reaction belt engaging an opposite surface of the handrail, said reaction belt being reeved about spaced apart end roller;

(d) a plurality of reaction rollers interposed between said end rollers, said reaction rollers being mounted on L-shaped rods having a horizontal axle part for journaling the reaction rollers, and having a vertical stem part disposed on a side of said plate opposite said presser rollers;

(e) means for biasing said reaction rollers against said reaction belt to urge said reaction belt against the handrail thereby forcing the handrail against said drive belt; and (f) motive means for driving said drive belt about said deflection rollers.

2. The drive assembly of claim 1 wherein said means for biasing comprises coil springs mounted on said vertical stem parts of said L-shaped rods.

3. The drive assembly of claim 2 wherein said vertical stem parts are threaded and carry adjustable stop nuts for engaging an end of said coil springs.

4. A drive assembly for a moving handrail in a passenger conveyor, said drive assembly comprising:

(a) an endless drive belt engaging one surface of the handrail, said drive belt being reeved about a pair of spaced apart deflection rollers;

(b) a plurality of presser rollers interposed between said deflection rollers and engaging said drive belt to hold the latter against the handrail;

(c) an endless reaction belt engaging an opposite surface of the handrail, said reaction belt being reeved about spaced apart end rollers;

(d) a plurality of reaction rollers interposed between said end rollers, said reaction rollers being mounted on L-shaped rods, said rods having a horizontal axle portion on which said reaction rollers are journaled, and said rods having a vertical stem portion;

(e) spring means mounted on said stem portions of said rods for biasing said reaction rollers against said reaction belt to urge said reaction belt against the handrail thereby forcing the handrail against the drive belt; and (f) motive means for driving said drive belt about said deflection rollers.

5. The drive assembly of claim 4 wherein said vertical stem portions are threaded and carry adjustable stop nuts for engaging an end of said coil springs.

* * * * *